US005496030A

United States Patent [19]

Fernandez

[11] Patent Number: 5,496,030

[45] Date of Patent: Mar. 5, 1996

[54] PINBALL KICK BACK PLAY FEATURE

[75] Inventor: Claude A. Fernandez, Palantine, Ill.

[73] Assignee: Capcom Coin-Op, Inc., Arlington Heights, Ill.

[21] Appl. No.: 433,710

[22] Filed: May 2, 1995

[51] Int. Cl.[6] ..... A63F 7/22

[52] U.S. Cl. ..... 273/119 R; 273/119 A; 273/129 S; 273/129 R; 273/127 R; 273/121 A

[58] Field of Search ..... 273/118, 119, 273/121, 127 R, 127 D, 129 R, 129 S, 129 V

[56] References Cited

U.S. PATENT DOCUMENTS

| | | | |
|---|---|---|---|
| 3,901,511 | 8/1975 | Garbark | 273/119 A |
| 4,148,486 | 4/1979 | Tepper | 273/121 R |
| 4,300,769 | 11/1981 | Momura | 273/129 V |
| 4,311,311 | 1/1982 | Crosman | 273/121 A |
| 4,426,081 | 1/1984 | Fainzilberg | 273/127 D |
| 4,437,664 | 3/1984 | Wiczer et al. | 273/121 A |
| 4,934,699 | 6/1990 | Kaminkow et al. | 273/121 A |
| 5,123,647 | 6/1992 | Lawlor et al. | 273/121 A |
| 5,186,462 | 2/1993 | Biagi et al. | 273/129 S |
| 5,226,653 | 7/1993 | Bil et al. | 273/121 A |
| 5,350,174 | 9/1994 | Ritchie et al. | 273/121 A |
| 5,364,096 | 11/1994 | Cebula et al. | 273/121 A |
| 5,415,403 | 5/1995 | Ritchie et al. | 273/119 A X |

*Primary Examiner*—Raleigh W. Chiu
*Attorney, Agent, or Firm*—Robert E. Browne; Gary R. Jarosik

[57] ABSTRACT

A pinball machine is provided and includes an inclined playfield for supporting a rolling ball. The inclined playfield has associated therewith at least one flipper, an exit lane, and a drain hole. A door mechanism having a retractable door is positioned adjacent to the exit lane and a holding area is positioned behind the door for allowing a ball to be stored therein whereby the ball is prevented from continuing down the exit lane and into the drain hole. A kicker mechanism is also associated with the holding area for launching the ball from the holding area back through the exit lane and into the play area of the playfield. A first switch is positioned upon the playfield and is operable through contact with the ball for causing the door to move from a first position wherein the ball is prevented from accessing the holding area to a second position wherein the ball is allowed to access the holding area. A second switch is positioned remotely from the playfield and is operable by a player of the pinball machine for causing the kicker mechanism to launch the ball from within the holding area.

20 Claims, 3 Drawing Sheets

PINBALL KICK BACK PLAY FEATURE

BACKGROUND OF THE INVENTION

This invention relates generally to amusement games and, more particularly, relates to a play feature for allowing a pinball to be kicked back onto the playfield during pinball game play.

The typical pinball game consists of an inclined playfield supporting a rolling ball, a plurality of play features such as targets, bumpers, ramps and the like, and player operated flippers to direct the ball at selected play features thereby to control play and score points. To begin play of the game, a player typically manipulates a spring loaded plunger that propels the ball up a shooter lane and onto the playfield. Play continues until the ball drains from the playfield via a drain hole. In the typical pinball game the drain hole is located behind the flippers such that if the player misplays the ball it will roll between the flippers into the drain hole and exit the playfield to terminate play of the ball. Furthermore, an exit lane is also typically provided on the playfield which creates a path leading from the playfield and behind the flippers whereby the ball is caused to move directly into the drain hole without providing the player the opportunity to "save" the ball through activation of the flippers. To control access of the ball to the exit lane a gate is typically provided which is controlled by the pinball microprocessor to move between a first position which blocks the exit lane and a second position which allows the ball to access the exit lane. While this provides some variation to game play and allows for some increase in the time of play, there exists a need for a novel means for preventing a ball from entering the exit lane whereby player interest may be elevated.

As a result of this existing need, it is an object of the present invention to provide an improved play feature which will attract and entice players into playing a particular pinball machine through renewed interest.

It is a further object of the present invention to provide a novel means for preventing a pinball from exiting the playfield via the exit lane.

It is still another object of the present invention to provide a device for allowing any number of pinballs to be stored and/or played during the course of game play in a pinball machine.

SUMMARY OF THE INVENTION

In accordance with the present invention, a pinball machine is provided and includes an inclined playfield for supporting a rolling ball, a door mechanism associated with the playfield having a movable door, a holding area positioned behind the door for allowing the ball to be stored therein, a kicker mechanism associated with the holding area for launching the ball therefrom, a first switch associated with the door mechanism for causing the door to move from a first position wherein the ball is prevented from accessing the holding area to a second position wherein the ball is provided access to the holding area, and a second switch associated with the kicker mechanism and the door mechanism for causing the door to be positioned in the second position and for thereafter causing the kicker mechanism to launch the ball from the holding area.

A better understanding of the objects, advantages, features, properties and relationships of the invention will be obtained from the following detailed description and accompanying drawings which set forth an illustrative embodiment and is indicative of the various ways in which the principles of the invention may be employed.

BRIEF DESCRIPTION OF THE DRAWINGS

For a better understanding of the invention, reference may be had to the preferred embodiment shown in the following drawings in which.

DETAILED DESCRIPTION

While the invention can be used in conjunction with most amusement games it will be described hereinafter in the context of a pinball machine including an exit lane as the preferred embodiment thereof.

Figure 1:
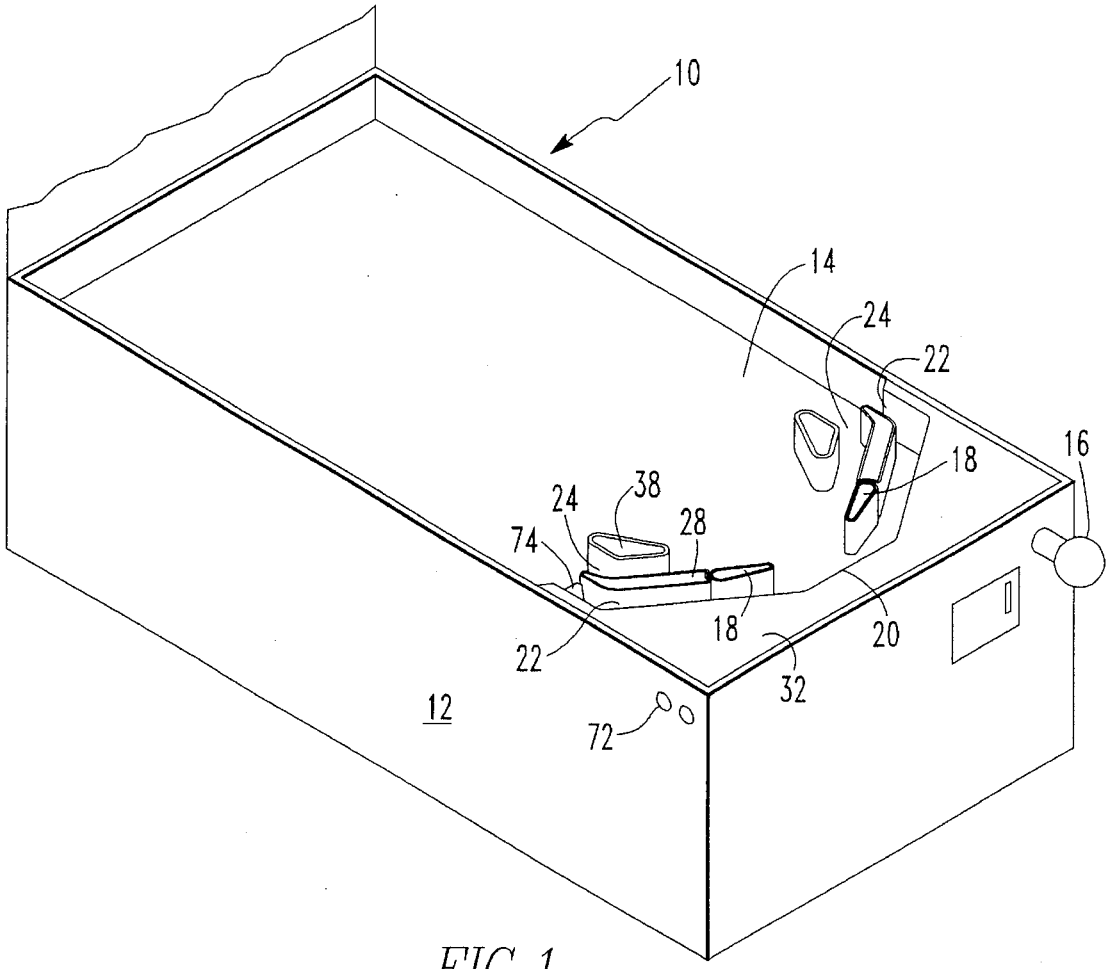
FIG. 1 illustrates a pinball machine which will carry the present invention.

Referring now to the figures, wherein like reference numerals refer to like elements, there is shown in FIG. 1 a pinball machine 10. As is conventional, the pinball machine 10 generally comprises a cabinet 12 supporting an inclined playfield 14 which in turns carries the play features (not shown) associated with the pinball machine 10, a plunger 16 for placing the ball into play upon the playfield 14, a pair of flippers 18 for keeping the ball in play upon the playfield 14, and a drain hole 20 into which a misplayed ball will fall for eventual positioning in front of the plunger 16 for allowing play to be restarted.

The pinball machine 10 is further provided with a pair of exit lanes 22 and a pair of flipper lanes 24 into which the ball may travel during the course of play. It is understood by those skilled in the art that the flipper lanes 24 are provided to direct the ball to the area of the playfield 14 in front of the flippers 18 whereby the flippers 18 may be used to place the ball in play upon the playfield 14. It is also understood by those skilled in the art that the exit lanes 22 are provided to direct the ball to the area of the playfield 14 behind the flippers 18 whereby the flippers 18 will not be able to prevent or "save" the ball from leaving the playfield 14 through the drain hole 20.

Figure 2:
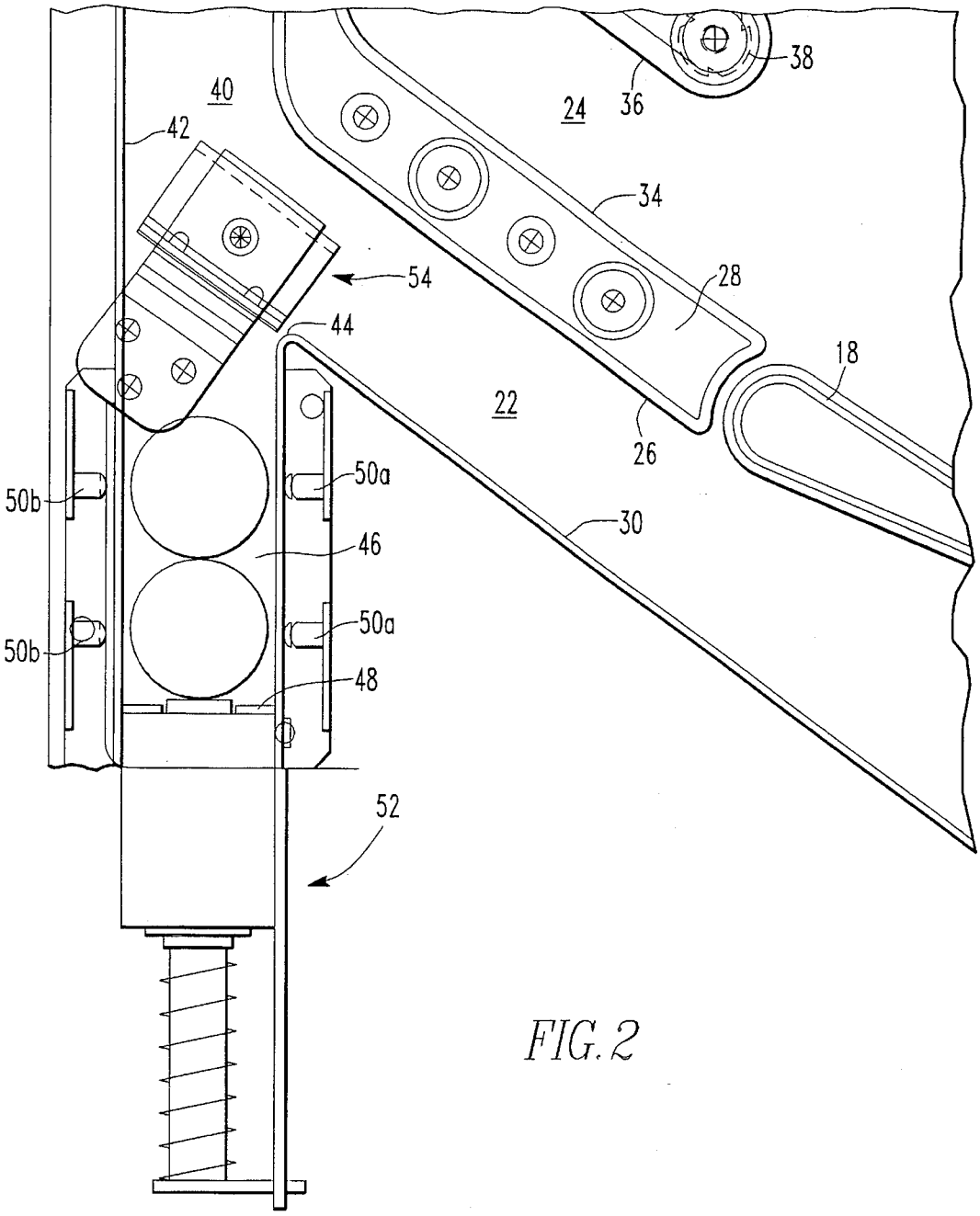
FIG. 2 illustrates a close-up view of the pinball machine of FIG. 1 and the kick back mechanism which is the subject of the present invention.

Turning to FIG. 2, there is shown a close-up of the area of the playfield 14 in the vicinity of the left flipper 18. As illustrated, the exit lane 22 is generally defined as the area of the playfield 14 positioned between wall 26 of guide 28 and wall 30 of ball trough housing 32. The flipper lane 24 is generally defined as the area of the playfield 14 positioned between wall 34 of guide 28 and wall 36 of bumper unit 38. In the preferred embodiment, the exit lane 22 has leading thereto an exit lane extension 40 which is generally defined as the area of the playfield positioned between side wall 42 and wall 26 of guide 28. As seen, the exit lane 22 preferably leads from the exit lane extension 40 at an angle whereby the pinball will be urged away from a course of direction generally parallel to the side wall 42 towards the drain hole 20.

Located generally at the position where the exit lane 22 meets the exit lane extension 40 is an opening 44 in the side wall 30 of the trough housing 32. The opening 44 is preferably of sufficient width to allow a pinball to pass therethrough. The opening 44 defines a mouth to a holding area 46 which is preferably enclosed by a continuation of the side wall 42, a continuation of the side wall 30, and an optional end wall 48. While the holding area 46 is visible as shown in FIG. 2, it is preferred that the holding area 46 is hidden from view of the player under the shield which generally defines ball trough housing 32.

In the illustrated embodiment, the holding area 46 is of sufficient length to hold a plurality of balls although it is contemplated that a one ball holding area may be provided. Furthermore, it is preferred that the holding area 46 be equipped with sensors, such as optical sensor pairs 50*a*, 50*b* or the like type of sensing switch, whereby the pinball machine microprocessor may track the presence or absence as well as the number of balls within the holding area 46. The holding area 46 is also equipped with a kicker device 52 located proximate to the back of the holding area 46, operable through an opening in the back wall 48 should such a wall be provided, and a retractable door mechanism 54 located in the area of the mouth of the holding area 46. The purpose and function of the kicker device 52 and the door mechanism 54 will be described in greater detail hereinafter.

Figure 3:
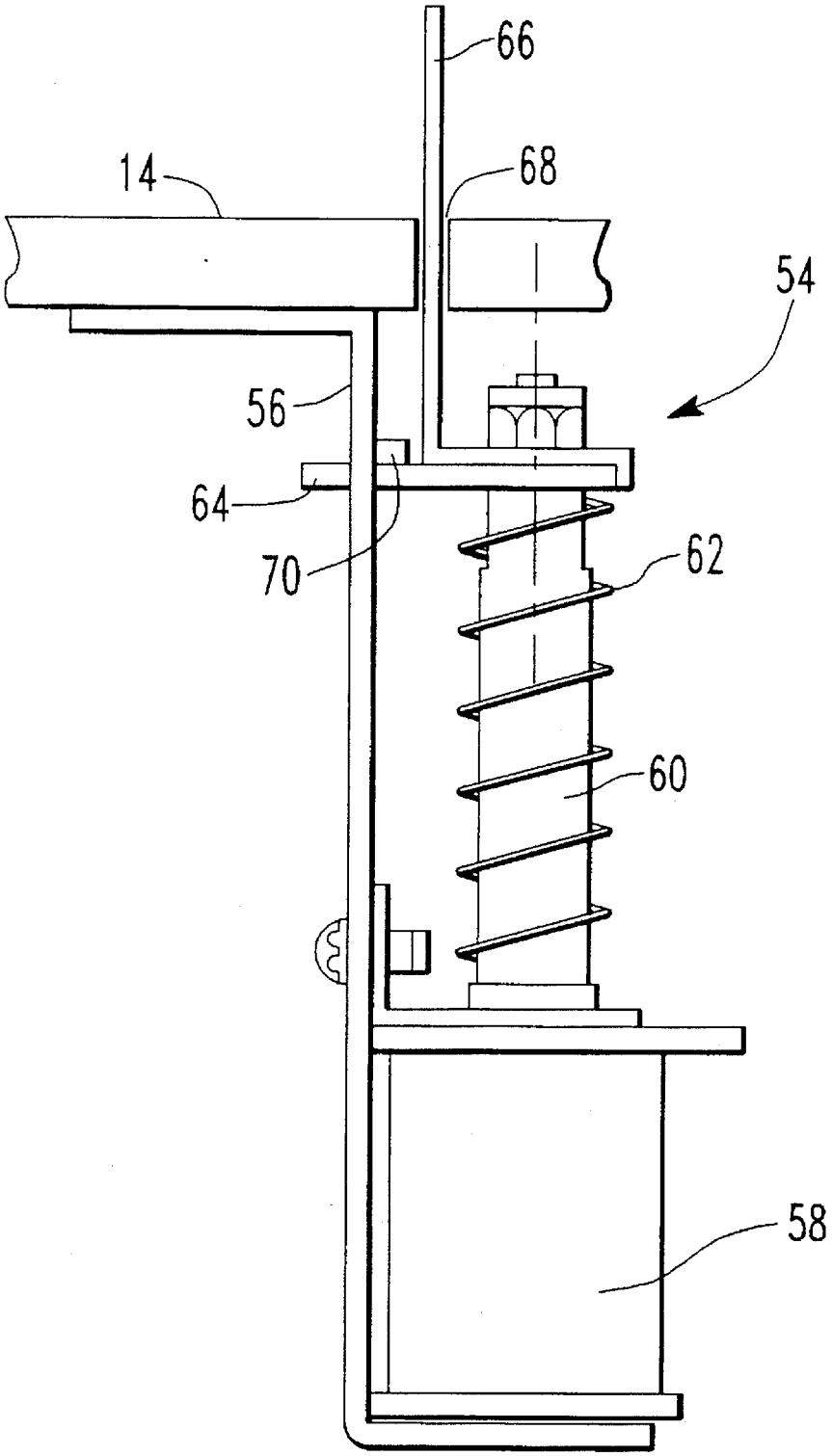
FIG. 3 illustrates the door mechanism which is associated with the kick back mechanism illustrated in FIG. 2.

Turning to FIG. 3, the door mechanism 54 is illustrated in greater detail. The door mechanism 54 includes a bracket 56 which is mounted to the underside of the playfield 14 in a conventional manner. The bracket 56 supports a conventional solenoid 58 which has extending therefrom a plunger 60. In the preferred embodiment the plunger 60 is biased by a spring 62 in the extended position whereby the plunger 60 will be caused to be fully extended when the solenoid 58 is inactive. Activation of the solenoid 58 will be seen to cause the plunger 60 to retract into the solenoid 58 against the bias of the spring 62. Attached to the distal end of the plunger 60 is a platform 64 which has mounted thereon a door 66. The door 66 is extendable through an opening 68 in the playfield 14. Preferably, the platform 64 includes a projection which engages a slot within the bracket 56 for allowing the slot to guide the plunger during any motion thereof. Furthermore, the platform 64 is preferably provided with a cross-piece 70 which functions by interacting with the bracket 56 to provide stability to the door 66 against any lateral force placed thereupon. The door 66 is preferred to be normally extended through the opening 68 in the playfield 14 during the course of play.

During play, when the door 66 is normally extended, a ball entering the exit lane extension 40 will proceed theredown until contact with the door 66 of door mechanism 54 is achieved. As seen, the door 66 is preferably angled away from the side wall 42, being generally co-planar with the side wall 30, whereby the ball, upon reaching the end of the exit lane extension 40, will follow the angle of the door 66 into the exit lane 22 whereafter the ball will be directed into the drain hole 20.

To change the normally extended position of the door 66 to the retracted position, whereby the door will no longer function to influence the course of the ball, it is preferred that a predetermined play feature or switch (not shown) be provided upon the playfield which may be contacted by the ball during play which play feature or switch will cause the door 66 to be retracted by the solenoid 58. It is also contemplated that an external, player operable switch may be provided for this same purpose. As will be understood by those skilled in the art, activation of the solenoid 58 causes the plunger 62 to retract against the bias of the spring 62 whereby the door 66 will be fully retracted into the opening 68 in playfield 14.

When the door 66 is positioned in the retracted position, a ball entering the exit lane extension 40 will follow the lane to the mouth of the holding area 46 where the pinball will pass therethrough over the door 66 for storage within the holding area 46. As is evident, by placing the ball within the holding area 46 the pinball will not enter the exit lane 22 and, therefore, will not be directed to the drain hole 20. Preferably, upon sensing the presence of a ball within the holding area 46, the door 56 is again caused to be raised to its normal, extended position through deactivation of the solenoid while a new ball is provided to the player for allowing the player to place the new ball into play upon the playfield 14.

In the preferred embodiment, the ball stored within the holding area 46 is maintained therein until a player activatable, external switch 72 is closed at which time the ball will be launched back into play upon the playfield 14. It is also contemplated that this switch could be positioned internally upon the playfield and/or associated with a predetermined play feature for allowing the ball to activate the switch and associated kicker mechanism 52. Closure of the activation switch will first cause the solenoid 58 to be activated whereby the door 66 will be caused to be retracted. Immediately thereafter, the kicker mechanism 52 will activate to cause the ball positioned within the holding area 46 to be launched back through the exit lane extension 40 and onto the main play area of the playfield 14. Once the ball is launched from the holding area 46 onto the playfield the door will once again attain the normally extended position as the solenoid 58 will once again become inactive. In addition, an optional guide 74 may be provided upon the playfield 14 in the vicinity of the entrance to the exit lane extension 40 which guide 74 will act to direct the launched ball onto the playfield to a predetermined location thereon. While a solenoid is illustrated as the preferred kicker mechanism 52 it is contemplated that any device or mechanism capable of imparting a moving force upon the ball to launch the ball from the holding area 46 may be used.

While the above example describes operation of the kick back mechanism for the storage of one ball it is to be understood by those skilled in the art that the previously described steps may be modified to allow multiple balls to be stored within the holding area. Furthermore, it is robe understood that any number of kick back mechanisms similar to the one above described may be employed within the pinball game and that these mechanisms need not be limited to a position adjacent to the exit lane.

It is to be noted that the advantage of providing an external switch for the player to activate is found in providing the player with the ability to launch a ball from the holding area where the player will be able to use the launched ball to influence the direction of another ball in play. For example, the player may desire to launch the ball from the holding area to prevent another ball from entering the exit lane 22 thereby "saving" the ball from entering the drain hole. Furthermore, this mechanism also provides the player with the ability to self determine when multiple ball play is desired, for example, as when bonus play is active upon the playfield.

While specific embodiments and examples of operation of the invention have been described in detail, it will be appreciated by those skilled in the art that various modifications and alternatives to those details could be developed in light of the overall teachings of the disclosure. Accordingly, the particular arrangements and examples disclosed herein are meant to be illustrative only and not limiting as to the scope of the invention which is to be given the full breadth of the appended claims and any equivalents thereof.

What is claimed is:

1. A pinball machine, comprising:

an inclined playfield for supporting a rolling ball having associated therewith at least one flipper;

a door mechanism associated with said playfield having a movable door;

a holding area positioned behind said door for allowing said ball to be stored therein;

a kicker mechanism associated with said holding area for launching said ball therefrom;

a first switch associated with said door mechanism for causing said door to move from a first position wherein said ball is prevented from accessing said holding area to a second position wherein said ball is provided access to said holding area; and a second switch associated with said kicker mechanism and said door mechanism for causing said door to be positioned in said second position and for thereafter causing said kicker mechanism to launch said ball from said holding area.

2. The pinball machine as recited in claim 1, wherein said first switch is positioned upon said playfield and operable through interaction with said ball.

3. The pinball machine as recited in claim 2, wherein said second switch is positioned remotely from said playfield and operable by a player of said pinball machine.

4. The pinball machine as recited in claim 1, wherein said first switch is positioned remotely from said playfield and operable by a player of said pinball machine.

5. The pinball machine as recited in claim 1, wherein said playfield has an opening through which said door is movable and wherein said first position comprises said door extending through said opening and said second position comprises said door being retracted from said opening to a level below the surface of said playfield.

6. The pinball machine as recited in claim 5, wherein said kicker mechanism comprises a solenoid.

7. The pinball machine as recited in claim 1, further comprises a means for detecting the presence of said ball within said holding area.

8. The pinball machine as recited in claim 7, wherein said detecting means comprises an optical switch.

9. The pinball machine as recited in claim 1, wherein said playfield has associated therewith an exit lane generally positioned behind said flipper and wherein said holding area is positioned adjacent said exit lane.

10. The pinball machine as recited in claim 1, wherein a plurality of balls may be supported upon said playfield and wherein said holding area is of sufficient area to store a predetermined number of said plurality of balls.

11. A pinball machine, comprising:

an inclined playfield for supporting a rolling ball having associated therewith at least one flipper, a drain hole, and an exit lane;

a holding area positioned adjacent to said exit lane for accepting and storing said ball therein and for preventing said ball from traveling down said exit lane and into said drain hole;

a kicker mechanism associated with said holding area for launching said ball from said holding area back through said exit lane; and a first switch associated with said kicker mechanism for causing said kicker mechanism to launch said ball.

12. The pinball machine as recited in claim 11, further comprising a guide positioned adjacent said exit lane for directing said ball from said holding area to a predetermined location on said playfield.

13. The pinball machine as recited in claim 11, further comprising a door mechanism having a movable door associated with said holding area wherein said door is movable between a first position for allowing said ball to access said holding area and a second position for preventing said ball from accessing said holding area.

14. The pinball machine as recited in claim 13, further comprising a second switch for causing said door to move between said first position and said second position.

15. The pinball machine as recited in claim 11, wherein said first switch is positioned remotely from said playfield and operable by a player of said pinball machine.

16. The pinball machine as recited in claim 15, further comprising a door mechanism having a movable door associated with said holding area wherein said door is movable between a first position for allowing said ball to access said holding area and a second position for preventing said ball from accessing said holding area.

17. The pinball machine as recited in claim 16, further comprising a means for detecting the presence of said ball within said holding area.

18. The pinball machine as recited in claim 17, wherein said detecting means comprises an optical switch.

19. The pinball machine as recited in claim 18, wherein said kicker mechanism comprises a solenoid.

20. A pinball machine, comprising:

an inclined playfield for supporting a rolling ball having associated therewith at least one flipper, an exit lane, and a drain hole;

a door mechanism having a retractable door positioned adjacent to said exit lane;

a holding area positioned behind said door for allowing a ball to be stored therein whereby said ball is prevented from continuing down said exit lane and into said drain hole;

a kicker mechanism associated with said holding area for launching said ball from said holding area back through said exit lane;

a first switch positioned upon said playfield and operable through contact with said ball for causing said door to move from a first position wherein said ball is prevented from accessing said holding area to a second position wherein said ball is allowed access to said holding area;

a second switch positioned remotely from said playfield and operable by a player of said pinball machine for causing said kicker mechanism to launch said ball from within said holding area; and a third switch associated with said holding area for detecting the presence or absence of said ball within said holding area.

* * * * *